US007362049B2

(12) United States Patent
Raukas et al.

(10) Patent No.: US 7,362,049 B2
(45) Date of Patent: Apr. 22, 2008

(54) BLUE-ENRICHED INCANDESCENT LAMP

(75) Inventors: Madis Raukas, Charlestown, MA (US); Kailash C. Mishra, North Chelmsford, MA (US)

(73) Assignee: Osram Sylvania Inc., Danvers, MA (US)

( * ) Notice: Subject to any disclaimer, the term of this patent is extended or adjusted under 35 U.S.C. 154(b) by 588 days.

(21) Appl. No.: 10/905,319

(22) Filed: Dec. 28, 2004

(65) Prior Publication Data

US 2006/0138930 A1 Jun. 29, 2006

(51) Int. Cl.
*H01K 1/26* (2006.01)
*H01K 1/32* (2006.01)

(52) U.S. Cl. ..... 313/578; 313/580; 313/486; 313/485; 313/315

(58) Field of Classification Search ..... 313/315, 313/316, 485–487, 569, 578–580
See application file for complete search history.

(56) References Cited

U.S. PATENT DOCUMENTS

| | | | | |
|---|---|---|---|---|
| 1,275,890 | A | 8/1918 | Flannery et al. | |
| 2,177,705 | A | 10/1939 | Friederich | 176/1 |
| 2,405,261 | A | 8/1946 | Levi et al. | 176/16 |
| 2,654,042 | A | 9/1953 | Clarke et al. | 313/109 |
| 2,759,119 | A | 8/1956 | Thorington | 313/109 |
| 2,995,463 | A | 8/1961 | Meister et al. | 117/17 |
| 3,125,457 | A | 3/1964 | Meister | 117/17 |
| 3,320,460 | A | 5/1967 | Bouchard et al. | 313/112 |
| 4,633,127 | A | 12/1986 | Beurskens et al. | 313/112 |
| 5,118,985 | A | 6/1992 | Patton et al. | 313/485 |
| 5,859,496 | A | 1/1999 | Murazaki et al. | |
| 6,197,218 | B1 * | 3/2001 | Hampden-Smith et al. | 252/301.4 R |
| 6,570,302 | B1 | 5/2003 | Boonekamp et al. | |
| 6,670,768 | B1 | 12/2003 | Labant | 315/112 |
| 2001/0033133 | A1 | 10/2001 | Juestel et al. | |
| 2002/0027420 | A1 | 3/2002 | Juestel et al. | |
| 2003/0197455 | A1 | 10/2003 | Oetken et al. | |

FOREIGN PATENT DOCUMENTS

| | | |
|---|---|---|
| EP | 1 429 370 A2 | 6/2004 |
| JP | 05028966 A * | 2/1993 |

* cited by examiner

*Primary Examiner*—Mariceli Santiago
(74) *Attorney, Agent, or Firm*—Robert F. Clark

(57) ABSTRACT

A blue-enriched incandescent lamp having on the interior surface of its light transmissive glass envelope a coating in accordance with an aspect of the invention. The coating contains a phosphor that is energized by the ultraviolet/violet emission (<420 nm) from the hot filament causing it to emit radiation in the range of 420 to 490 nm. In a preferred embodiment of the invention, the coating contains a europium-activated barium magnesium aluminate phosphor and a blue pigment.

4 Claims, 4 Drawing Sheets

BLUE-ENRICHED INCANDESCENT LAMP

TECHNICAL FIELD

This invention relates to incandescent lamps and more particularly to such lamps having enhanced emission in the blue region of the spectrum.

BACKGROUND OF THE INVENTION

The incandescent lamp has been the mainstay of illumination for well over one hundred years. It is simple to construct, relatively inexpensive to manufacture, easily transportable, and has a strong emission in the yellow-green portion of the spectrum. Numerous techniques have been employed over the years to modify the black-body emission of the hot filament. For example, U.S. Pat. No. 2,405,261 suggests adding a layer of a chrome green enamel to a clear enamel to modify the light output in the 500 to 560 nm range. U.S. Pat. No. 2,759,119 suggests adding a phosphor material to the interior of the lamp envelope, such phosphor material to be energized by the electron emission and the ultraviolet radiation from the tungsten filament to produce luminescence in the green portion of the spectrum. U.S. Pat. No. 5,118,985 suggests the inclusion of a phosphor material that absorbs radiation below 500 nm and emits radiation above 500 nm to provide an improved bugfoiler lamp.

Recently, incandescent lamps having an enriched emission in the blue region of the spectrum have been introduced for use in household applications, so-called "daylight" incandescent lamps. One of the methods for achieving this relative enhancement in the blue region has been to provide a blue-tinted glass for the envelope, e.g., a glass employing an additive of neodymium in the form of $Nd_2O_3$. Another technique, disclosed in U.S. Pat. No. 6,670,768, employs a coating employing a blue cobalt aluminate, $CoAl_2O_4$, pigment. Both of these techniques increase the relative proportion of blue in the emission spectrum of the lamp by absorbing a significant portion of the yellow light emitted by the filament

DISCLOSURE OF INVENTION

It is, therefore, an object of the invention to obviate the disadvantages of the prior art.

It is another object of the invention to enrich the blue emission of an incandescent lamp.

These and other objects are accomplished, in one aspect of the invention, by the provision of a blue-enriched incandescent lamp comprising: a light transmissive envelope; a filament within said envelope, the filament when operating producing at least an emission having a wavelength less than 420 nm; and a coating on the interior surface of said envelope, said coating comprising a phosphor that emits radiation in the range of 420 to 490 nm when stimulated by the emission from the filament. In a preferred embodiment of the invention, the coating contains a europium-activated barium magnesium aluminate phosphor and may contain a cobalt aluminate pigment. Other phosphors that may be used in this invention include: $XMgAl_{10}O_{17}$:Eu and $XMgAl_{10}O_{17}$:Eu,Mn (X=Sr and/or Ba), $XAl_2O_4$:Eu and $X_4Al_{14}O_{25}$:Eu, where X=Ca, Sr, and/or Ba, as well as $Sr_6B(PO_4)_5$:Eu, $Sr_2P_2O_7$:Eu, $X_5Cl(PO_4)_3$:Eu (X=Ca,Sr,Ba), and $Y_2O_3$:Bi. Since the incandescent lamps do not contain mercury, many sulfide, silicate, halide, oxyhalide and oxysulfide phosphors, e.g., ZnS, ZnS:Ag, and SrS:Eu, that are not used in Hg-discharge lamps could be employed for the present purpose. Blue-emitting phosphors developed for LED applications will also be suitable for this purpose, e.g., $BaGa_2S_4$:Eu.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
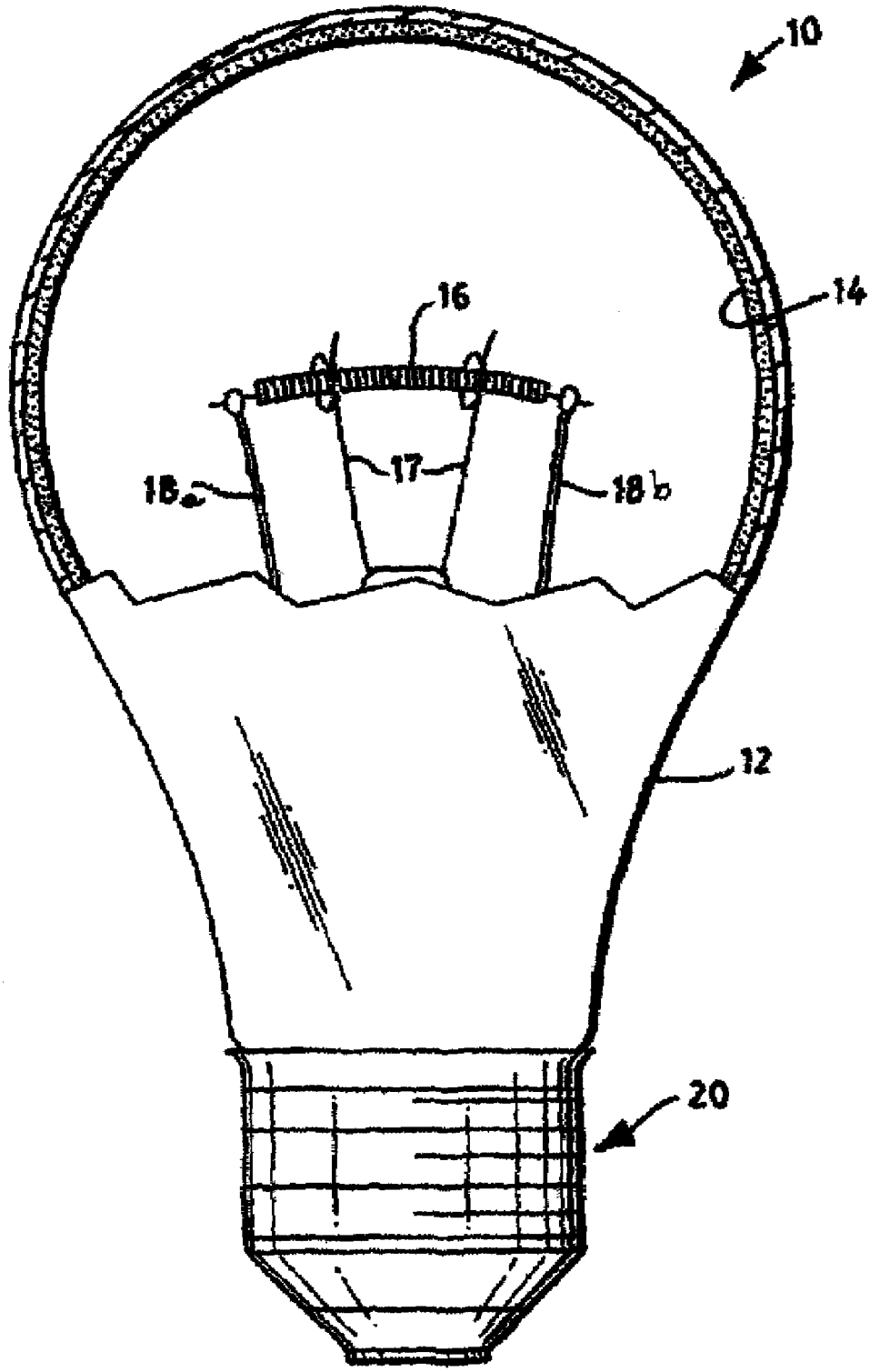
FIG. 1 is a diagrammatic view, partially in section, of an embodiment of the invention.

Referring now to the drawings with greater particularity, there is shown in FIG. 1 an A-line incandescent type lamp 10 having on the interior surface of its light transmissive glass envelope 12 a coating 14 in accordance with an aspect of the invention. A filament 16 of, for example, tungsten, is electrically connected to and supported by lead-ins 18*a* and 18*b*, which extend through the seal of the lamp and are attached, as is known, to a screw base 20. Other forms of bases can be employed, such as the type known in the art as a bayonet base. Additionally, support wires 17 can provide another support for the filament 16. Coating 14 can be applied via a slurry or, alternatively, the coating can be applied electrostatically by means well known to those skilled in the art. See, for example, U.S. Pat. Nos. 2,995,463; 3,125,457; 3,320,460 and 4,633,127.

Coating 14 contains a blue-emitting phosphor that is energized by the ultraviolet/violet emission (<420 nm) from the hot tungsten filament and as a result emits radiation in the range of 420 to 490 nm. In a preferred embodiment of the invention the phosphor comprises a europium-activated barium magnesium aluminate phosphor. Preferably, the phosphor has a general formula of $BaMgAl_{10}O_{17}$:Eu (hereinafter, and in the drawing figures, BAM). The coating can be enhanced even further by the addition of a blue pigment such as cobalt aluminate, $CoAl_2O_4$.

Figure 2:
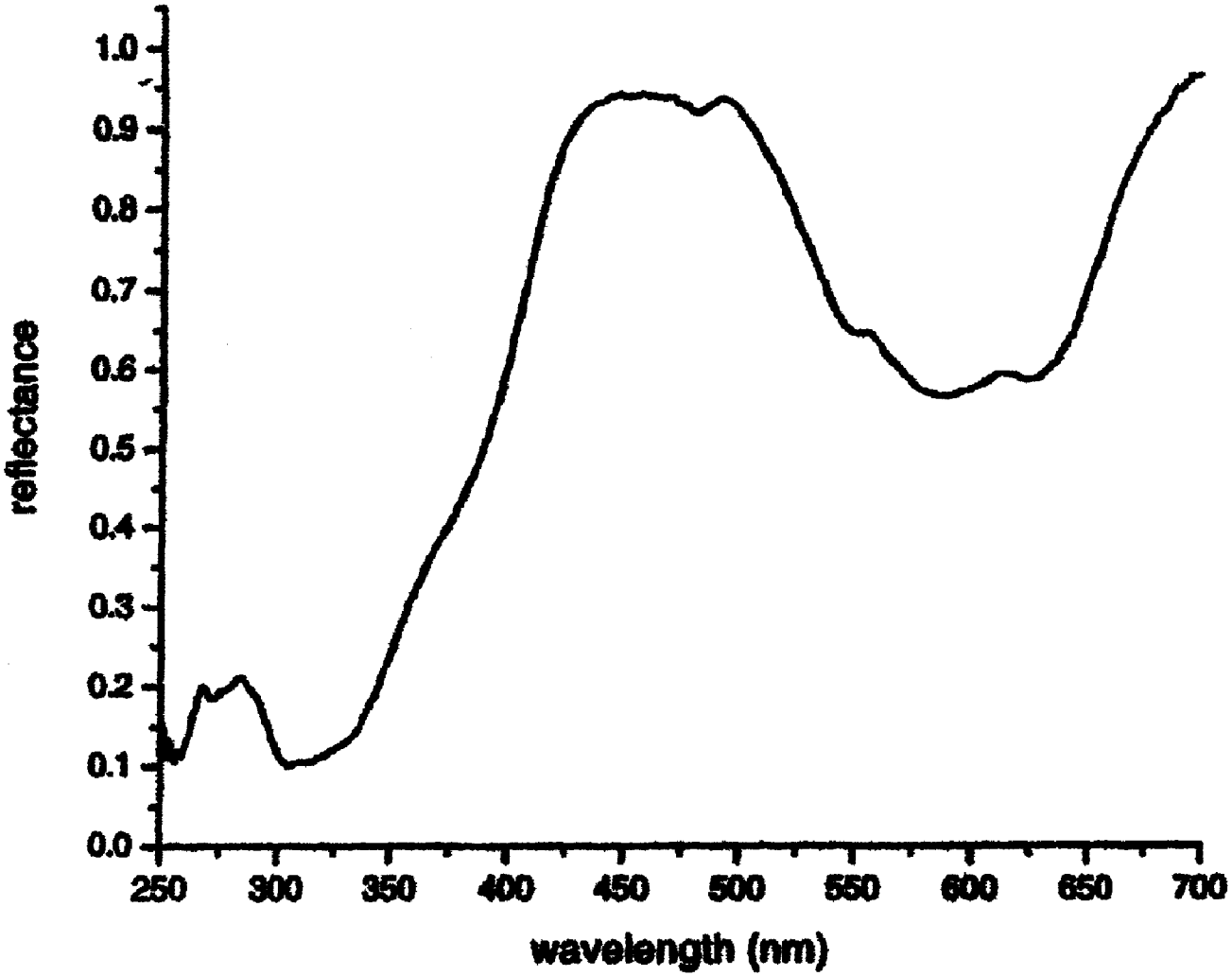
FIG. 2 is a graph of the reflectance of a coating comprising a blue-emitting phosphor and a blue pigment.

Referring now to FIG. 2 there is shown the reflectance curve of a coating according to this invention. The coating comprises a mixture of $BaMgAl_{10}O_{17}$:Eu (OSRAM SYLVANIA Type 2467) and 2 weight percent $CoAl_2O_4$. This coating provides strong absorption in the yellow part of the spectrum, thus providing a blue body color.

Figure 3:
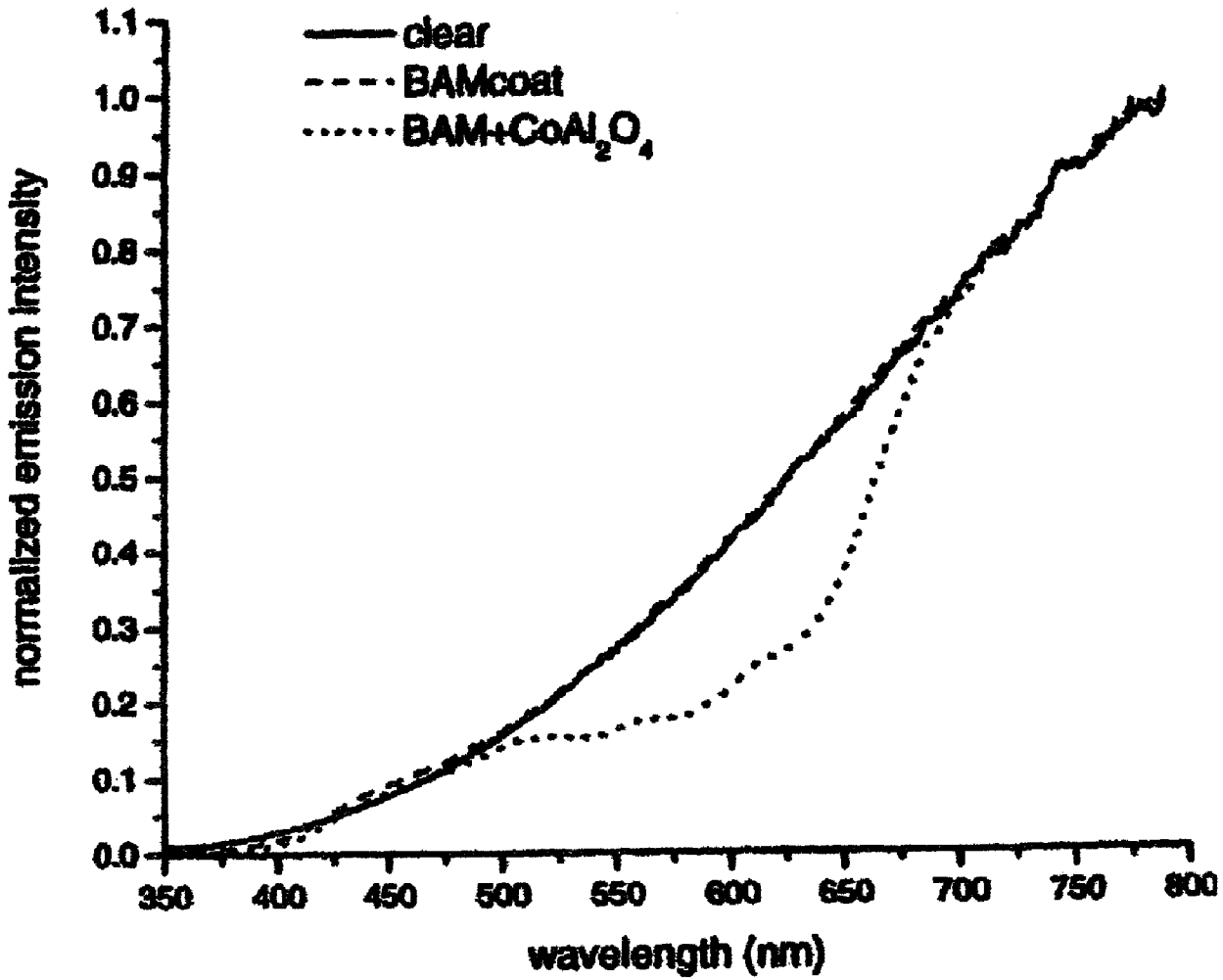
FIG. 3 is a graph of normalized emission curves of incandescent lamps having a clear envelope, an envelope coated with a blue-emitting phosphor, and an envelope coated with a mixture of the blue-emitting phosphor and a cobalt aluminate pigment.

FIG. 3 demonstrates the emission comparison of incandescent lamps having a clear envelope (the solid line), a phosphor-coated envelope (the dashed line) and an envelope coated with a phosphor and $CoAl_2O_4$. In each of these instances the phosphor is $BaMgAl_{10}O_{17}$:Eu.

Figure 4:
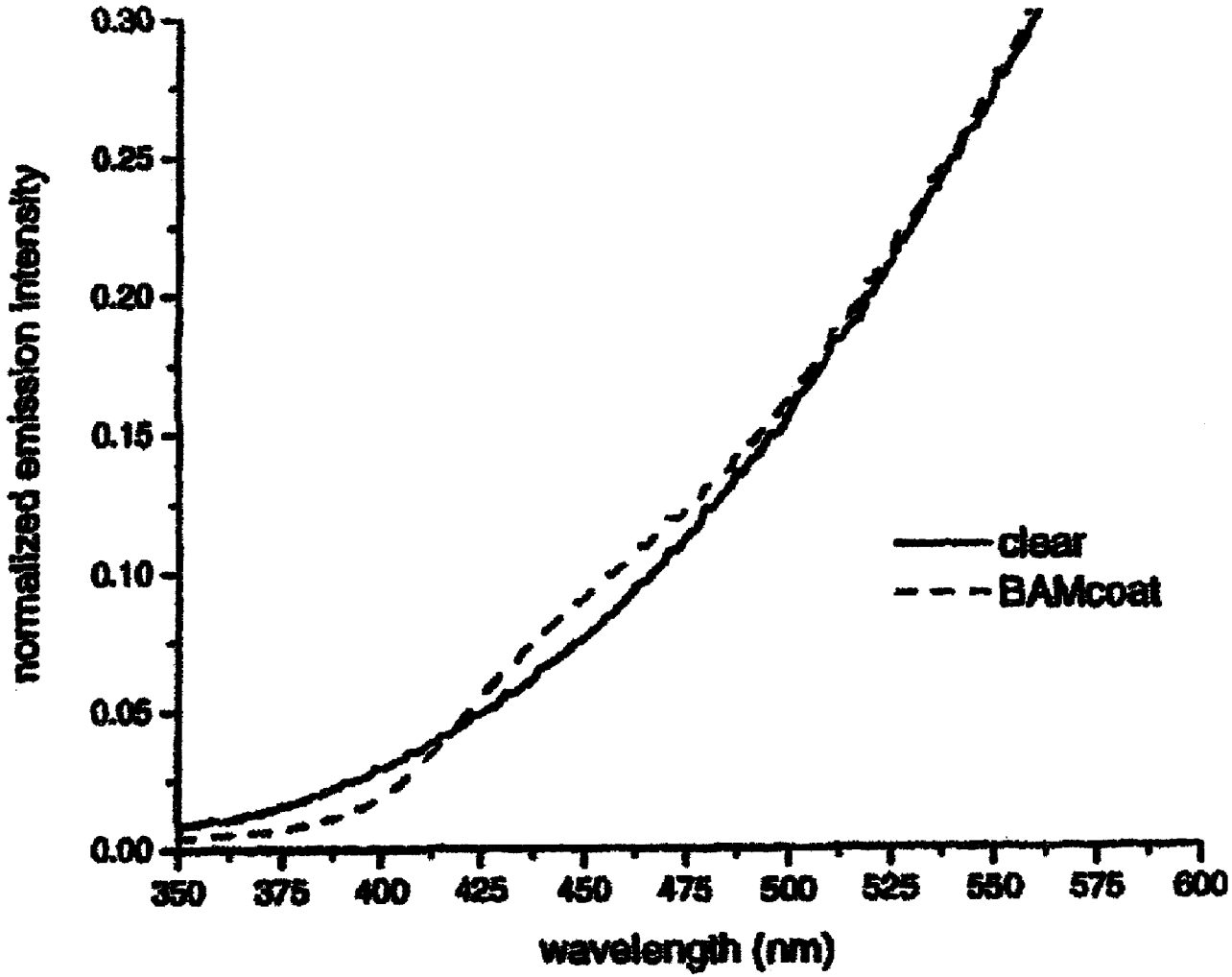
FIG. 4 is graph of the normalized emissions of incandescent lamps having a phosphor-coated envelope and a clear envelope.

FIG. 4 provides a detailed comparison of the normalized emission curves from a $BaMgAl_{10}O_{17}$:Eu coated incandescent lamp and a clear incandescent lamp. Both lamps were operated at 150 watts. The absorption of the short wavelength emission from the filament from about 350 nm to about 410 nm together with the enhanced emission at about 450 nm can be clearly seen.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A blue-enriched incandescent lamp comprising:

a light transmissive envelope;

a filament within said envelope, the filament producing at least an emission having a wavelength less than 420 nm when operating; and a coating on the interior surface of said envelope, said coating containing a phosphor having a general formula $BaMgAl_{10}O_{17}$: Eu that emits radiation in the range of 420 to 490 nm when stimulated by the emission from the filament.

2. The blue-enriched incandescent lamp of claim 1 wherein said coating further contains a blue pigment.

3. The blue-enriched incandescent lamp of claim 1 wherein said coating includes about 2 weight percent cobalt aluminate.

4. The blue-enriched incandescent lamp of claim 1 wherein said emitted radiation from the phosphor has a maximum at about 450 nm.

* * * * *